United States Patent [19]

Granzow et al.

[11] Patent Number: 4,585,144

[45] Date of Patent: Apr. 29, 1986

[54] RECORD MEMBER DISPENSING SYSTEM

[75] Inventors: Robert H. Granzow, Miamisburg; William R. Horst; William J. Hale, both of Dayton; Ralph B. Saunders, Moraine, all of Ohio

[73] Assignee: NCR Corporation, Dayton, Ohio

[21] Appl. No.: 163,749

[22] Filed: Jun. 26, 1980

[51] Int. Cl.[4] ..... B65H 29/02

[52] U.S. Cl. ..... 221/7; 211/73

[58] Field of Search ..... 221/2, 7, 69, 70, 71, 221/72, 73; 133/1 R, 4 R; 194/DIG. 26; 271/8

[56] References Cited

U.S. PATENT DOCUMENTS

| | | | |
|---|---|---|---|
| 2,417,497 | 3/1947 | Hulslander | 221/70 X |
| 2,840,265 | 6/1958 | Noyes . | |
| 2,981,492 | 4/1961 | Simjian . | |
| 3,446,328 | 5/1969 | Boyce et al. | 194/DIG. 26 |
| 3,650,876 | 3/1972 | Stageberg | 221/73 X |
| 3,675,816 | 7/1972 | Bourke et al. . | |
| 3,759,382 | 9/1973 | Walkley et al. . | |
| 3,958,583 | 5/1976 | Shigemori et al. | 133/4 R |
| 3,961,784 | 6/1976 | Sevak et al. . | |
| 3,973,237 | 8/1976 | Sawaguchi et al. . | |
| 3,987,931 | 10/1976 | Fell et al. | 221/73 |
| 4,337,864 | 7/1982 | McLean | 209/534 |

FOREIGN PATENT DOCUMENTS

| | | | |
|---|---|---|---|
| 677155 | 12/1963 | Canada | 221/69 |
| 11997 | 1/1977 | Japan | 221/73 |

*Primary Examiner*—F. J. Bartuska

*Attorney, Agent, or Firm*—Albert L. Sessler, Jr.; Elmer Wargo

[57] ABSTRACT

A currency dispenser having a housing having a discharge opening therein; a flexible, transparent carrier having bills of currency detachably mounted on carrier; a drive unit for moving the carrier within the housing so as to position successive ones of the bills near the opening and pick-off structure to separate the bills from the carrier and move them out of the discharge opening. Embodiments of the carrier include the use of adhesive members, tongue-like structures and a fan-folded configuration for providing single, spaced bills of currency on the carrier.

14 Claims, 13 Drawing Figures

FIG. 9
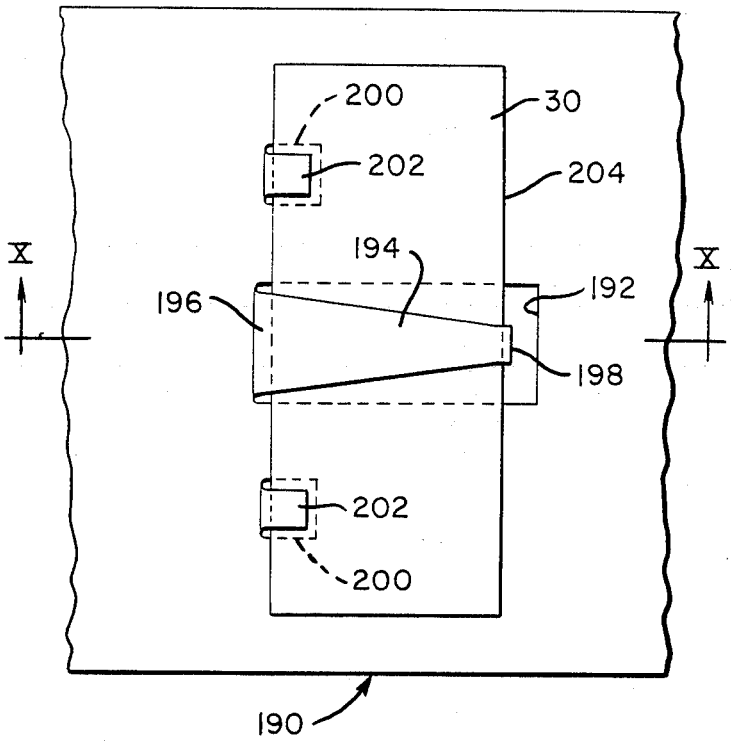
FIG. 10
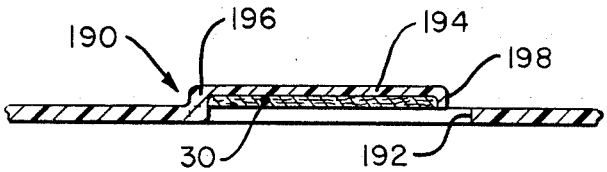
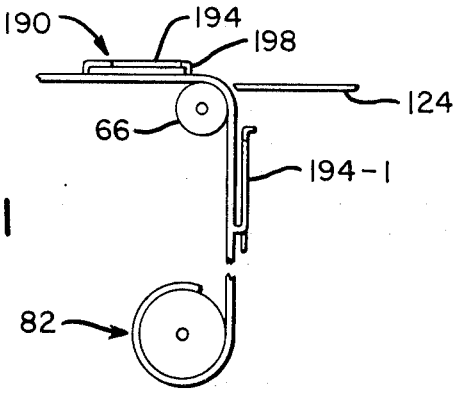
FIG. 11

RECORD MEMBER DISPENSING SYSTEM

BACKGROUND OF THE INVENTION

This invention relates to record member dispensing systems, and more particularly, it relates to currency dispensing systems.

Counting and dispensing currency is an important function which is performed by both bank tellers and the recently-introduced, Automated Teller Terminals (ATT's) which perform the counting and currency dispensing operation as one of their important functions.

With regard to ATT's, there are two basic currently-used, methods of dispensing currency to a customer. The first method is to package pre-determined amounts of currency in the form of envelopes or clips, with each such envelope or clip containing, for example, ?25.00 or ?50.00 when used with U.S.A. currency. The dispensing operation consists of dispensing the desired number of envelopes to equal the total monetary amount requested (in multiples of an amount per envelope) by a customer in a valid transaction.

The second general method of dispensing currency via ATT's is to store a stack of currency or bills within the terminal for each denomination of currency to be dispensed and to utilize a picker mechanism to pick a desired number of such bills from the appropriate stack of currency until the predetermined amount requested by the customer is dispensed. With this second method, costly hardware is required to check on the actual number of bills being dispensed, as this method is susceptible to picking off more than one bill at a time from the stack of currency. As a result of "double picking" of the bills, it is necessary to provide a "reject hopper" within the terminal where suspected miscounts of currency can be routed instead of delivering the suspected miscounts of currency to the customer access receptacle associated with the ATT. Because of the "double picking" situation mentioned, the supply of currency within the ATT is utilized sooner than would be the case if accurate counting were effected on the first try for each demand from a customer, thereby increasing the costs for servicing the terminal. Additionally, the provision of a reject hopper and the associated mechanisms for handling currency feeding errors increases the purchase cost of the ATT's.

SUMMARY OF THE INVENTION

In contrast with the two general currency dispensing methods mentioned earlier herein, the currency dispenser of this invention comprises: a housing having a discharge opening therein; a carrier means located within the housing for positioning bills of currency thereon; means for moving the carrier means within the housing so as to position successive ones of the bills adjacent to the discharge opening: and discharge means located near the discharge opening for removing successive ones of the bills from the carrier means and also for discharging successive ones of the bills through the discharge opening in response to a control unit.

In a first principal embodiment of the invention, the carrier means includes a web or belt to which a plurality of bills are retained by various means to provide a supply roll of bills on the belt. The bills on the belt are moved past the discharge means where the bills are picked therefrom and discharged to a customer. The portion of the belt having the bills removed is wound up on a take-up reel within the housing of the currency dispenser.

In a second principal embodiment of the invention which is similar to the first embodiment described in the previous paragraph, the take-up reel is eliminated, and the portion of the belt having the bills removed therefrom is permitted to accumulate in random folds or convolutions within an area within the housing of the dispenser.

In a third principal embodiment of the invention, the carrier means includes an endless web or belt which is formed into a plurality of fan folds to receive a plurality of bills with a single bill being located between adjacent folds of the carrier means.

Some of the advantages of this invention are as follows:

(1) Reliable dispensing of a predetermined amount of bills is obtained, thereby eliminating the need for a reject hopper and associated mechanism within an ATT.

(2) The loading of the currency dispensers with bills can be effected at a central office by automated equipment.

(3) The currency dispensers are self-contained units which can be made tamper-proof after loading at the central office for distribution to ATT's.

(4) The currency dispensers can be used by tellers at a bank to facilitate the counting of currency to customers.

(5) The currency dispensers can handle old or worn currency and also can handle a variety of sizes and shapes in accurate dispensing operations.

(6) The currency dispensers are re-useable.

(7) The currency dispensers include positive means for stripping each bill from the carrier means and provide an ease in monitoring the number of bills dispensed.

(8) The currency dispensers are capable of dispensing bills of currency, travellers' checks, coupons, and other record media; however, to facilitate the explanation of this invention, only the term "bills of currency" will be used in the specification and the claims although this term is intended to cover the various record media described.

(9) The currency dispensers provide a low-cost, accurate means for dispensing various kinds of record media or bills of currency.

The above advantages and others will be more readily understood in connection with the following detailed description, claims and drawing.

BRIEF DESCRIPTION OF THE DRAWING

FIG. 9 is a plan view of another embodiment of the currency carrier shown in block form in FIG. 1 with a bill positioned thereon;

FIG. 10 is a cross-sectional view, taken along the line 10—10 of FIG. 9 to show additional details of the embodiment shown in FIG. 9;

FIG. 11 is a side view similar to FIG. 7 and is intended to show how the currency carrier reacts with an element included in the discharge means shown only in block form in FIG. 1.

DETAILED DESCRIPTION OF THE INVENTION

Figure 1:
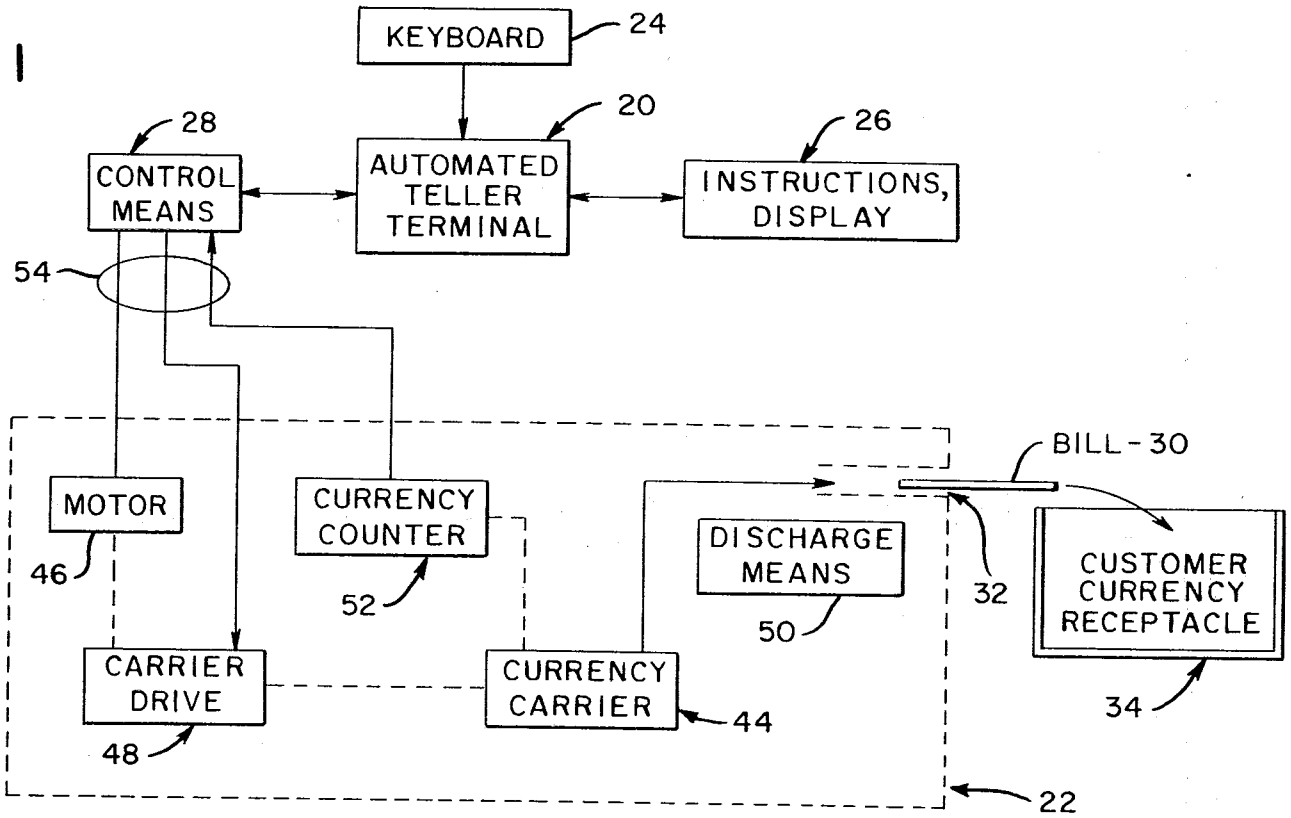
FIG. 1 is a schematic diagram, in block form, of an Automated Teller Terminal (ATT) in which a preferred form of the record member or currency dispensing system of this invention may be used, showing the dispensing system as a currency dispenser or cassette included in the dashed outline in the figure.

FIG. 1 is a schematic diagram, in block form, showing an ATT 20 in which the preferred embodiments of this invention may be used. The record member dispensing system of this invention, hereinafter referred to as a currency dispenser, is shown within the dashed outline 22.

The ATT 20 (FIG. 1) is conventional and will be described only generally, as the functioning of ATT's is well known. In general, a customer inserts an identification card (not shown) into an appropriate slot in the ATT 20 and enters a secret code number on the keyboard 24 to initiate a valid transaction on the ATT 20. Instructions to assist a user or customer of the ATT 20 in the operation thereof and also, keyed-in data, such as momentary amount requested from the customer's checking account, for example, appear on the display 26. The ATT 20 has an associated control means 28 for controlling the operation of the ATT 20 itself and the currency dispenser 22 when currency is to be dispensed therefrom. Assuming that the customer wants ?40.00 in U.S.A. currency in a valid transaction, and also assuming that the dispenser 22 is loaded with ?20.00 bills, then the dispenser 22 will dispense two bills 30 through a discharge opening 32 in the dispenser 22 into a receptacle 34 to which the customer has access to enable him to pick up the ?40.00 requested.

Figure 2:
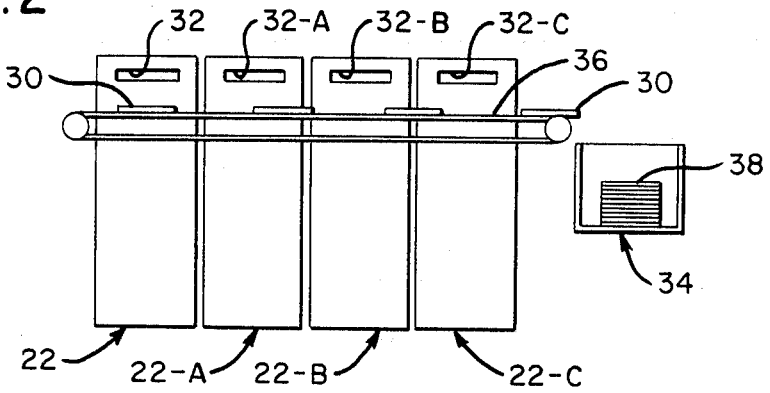
FIG. 2 is a schematic diagram showing how a plurality of currency dispensers identical to the one shown in FIG. 1 may be used to dispense different denominations of currency.

FIG. 2 shows how a plurality of dispensers 22, 22-A, 22-B, and 22-C, all identical to dispenser 22, may be utilized to provide more than one denomination of currency from an ATT 20, thereby enhancing its usefulness and versatility. In terms of U.S.A. currency, for example, the dispensers 22, 22A, 22B, and 22C may dispense ?20.00, ?10.00, ?5.00 and ?1.00 denominations of bills, respectively. Each dispenser such as 22-A, 22-B, and 22-C has a discharge opening 32-A, 32-B and 32-C, respectively, formed therein to enable the associated bill 30 to be dispensed therethrough onto a conveyor belt 36, which moves to the right as viewed in FIG. 2 to deposit the bills like 30 into the receptacle 34 (to form a stack 38 of bills therein) for access by the customer. Because the security measures which are used in the ATT 20 (to prevent unauthorized access by a customer or a potential thief) may be conventional, and do not form a part of this invention, they are not shown in FIGS. 1 and 2. Naturally, the number of currency dispensers like 22 and 22A used in a particular ATT depends upon a particular application.

Figure 3:
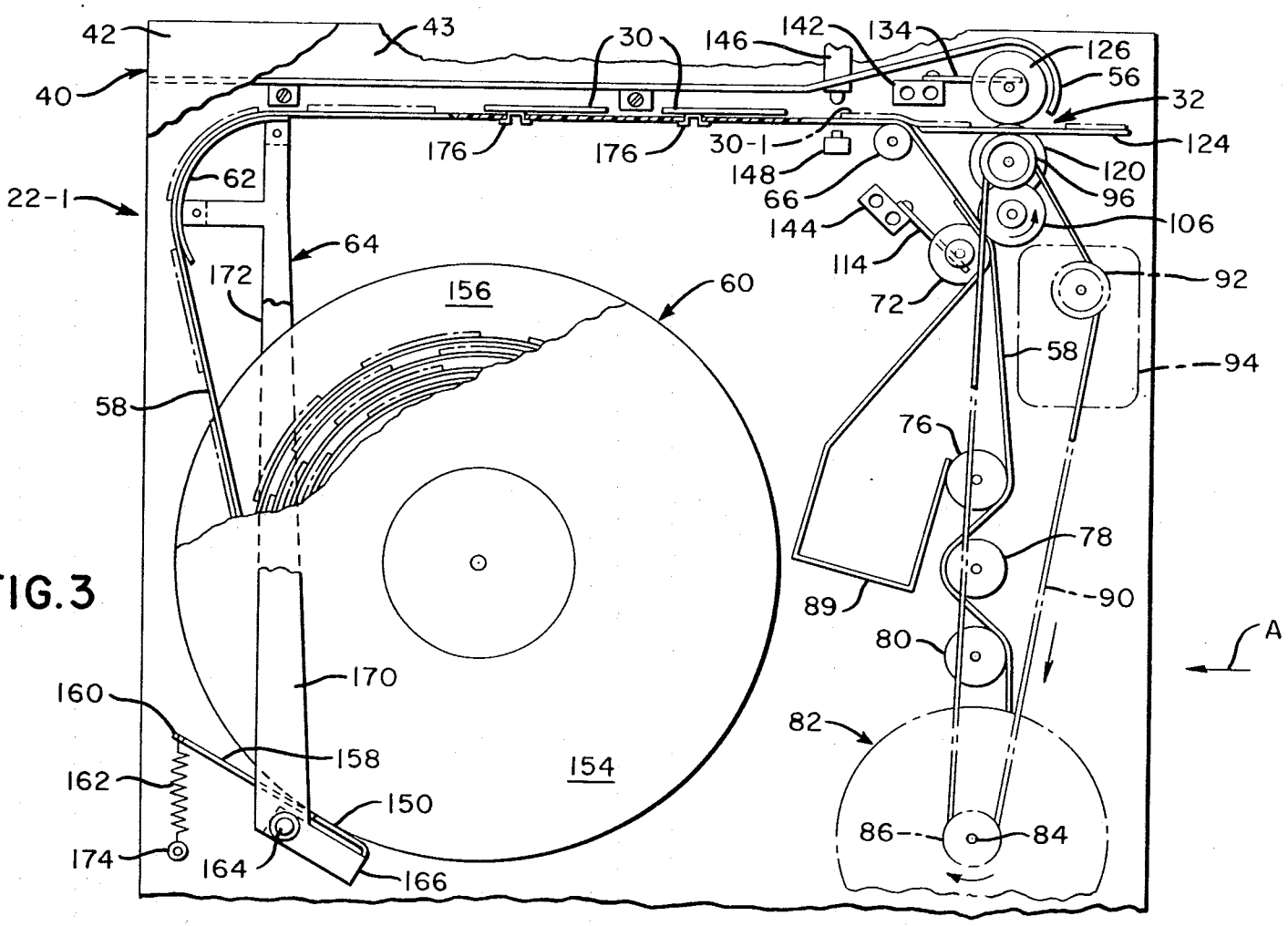
FIG. 3 is a side view of one embodiment of a currency dispenser made according to this invention.

The currency dispenser 22 (FIG. 1), in a preferred embodiment, includes a conventional tamper-proof housing 40 (FIG. 3) which has associated side panels 42 and 43, with most of side panel 42 being removed in FIG. 3, to facilitate a showing of the interior of the dispenser 22. The dispenser 22 (shown diagrammatically in FIG. 1) comprises a carrier means or currency carrier 44, and the motor 46 and a carrier drive 48 comprise the means for moving the currency carrier 44 within the dispenser 22 so as to position successive bills 30 near the discharge opening 32. Discharge means shown as block 50 in FIG. 1 are used to separate the bills 30 from the carrier 44 and to discharge them through the discharge opening 32 to the receptacle 34. A currency counter 52 operatively coupled with the carrier 44 and the control means 28 is utilized to count the number of bills 30 being dispensed from the dispenser 22. The motor 46, carrier drive 48, and the currency counter 52 are operatively coupled to the control means 28 by a control cable 54 (shown as an ellipse) so as to enable the currency dispenser 22 to function as a self-contained unit and to be easily connected to the control means 28 of the ATT 20 and the terminal itself. The currency dispenser 22 may be loaded with currency at a central office within a banking system, for example, as previously explained, and thereafter, it may be sealed with a tamper-proof seal such as 56 shown in FIG. 3 and delivered to an ATT 20 for installation therein. Because the seal 56 and the tamper-proof housing 40 may be conventional, they are shown only diagrammatically in FIG. 3.

FIG. 3 is a side view of one embodiment 22-1 of the currency dispenser 22 which is shown only diagrammatically in FIG. 1, with certain portions of the housing 40 being removed as previously explained to facilitate a showing of the interior thereof.

The currency carrier 44 (FIG. 1) in the currency dispenser 22-1 shown in FIG. 3 includes a length or strip 58 of flexible material such as a clear plastic which has a plurality of bills 30 detachably secured thereto in spaced relationship thereon. The strip 58 with the bills 30 thereon is fed: from a supply reel 60 over an arcuately shaped surface 62 (which is part of a brake mechanism 64 to be later described herein); over an arcuately-shaped element 66; between drive rollers 68 and 70 and back-up rollers 72 and 74 (best seen in FIG. 4); and over the cylindrically-shaped friction rods 76, 78, and 80. Thereafter, the empty strip 58 with the bills 30 removed therefrom is fed to the take-up reel 82. The reel 82 is rotatably supported on a rod 84 which is supported in the side panels 42 and 43. The reel 82 has a conventional slip clutch 86 operatively connected thereto so as to maintain a predetermined amount of torque on the reel 82 to thereby rotate it in a clockwise direction as viewed in FIG. 3 and to keep a predetermined amount of tension on the strip 58. The rods 76, 78, and 80 do not rotate and are made of a material such as "Delrin", a plastic material made by DuPont, and these stationary rods provide the necessary friction to prevent the take-up reel 82 from driving the strip 58 past the drive rollers 68, and 70 and their associated back-up rollers 72 and 74, respectively. Because of differences in inertia and other start-up forces of the combined supply reel 60 and strip 58 in comparison with the take-up reel 82, the strip 58 may be driven at a rate which is faster than the rate at which the take up reel 82 can wind up the strip 58, for brief periods of time resulting in an excess of the strip 58 accumulating between the back-up roller 72, for example, and the rod 76; the excess of the strip 58 collects in the bin 89 and is drawn out thereof at a slower rate as the take-up reel 82 accelerates in speed. The reel 82 is rotated in a clockwise direction (as viewed in FIG. 3) by an endless, gear-type, drive belt 90 which is coupled to the driving pulley 92 of a motor 94 which is located within the housing 40.

Figure 4:
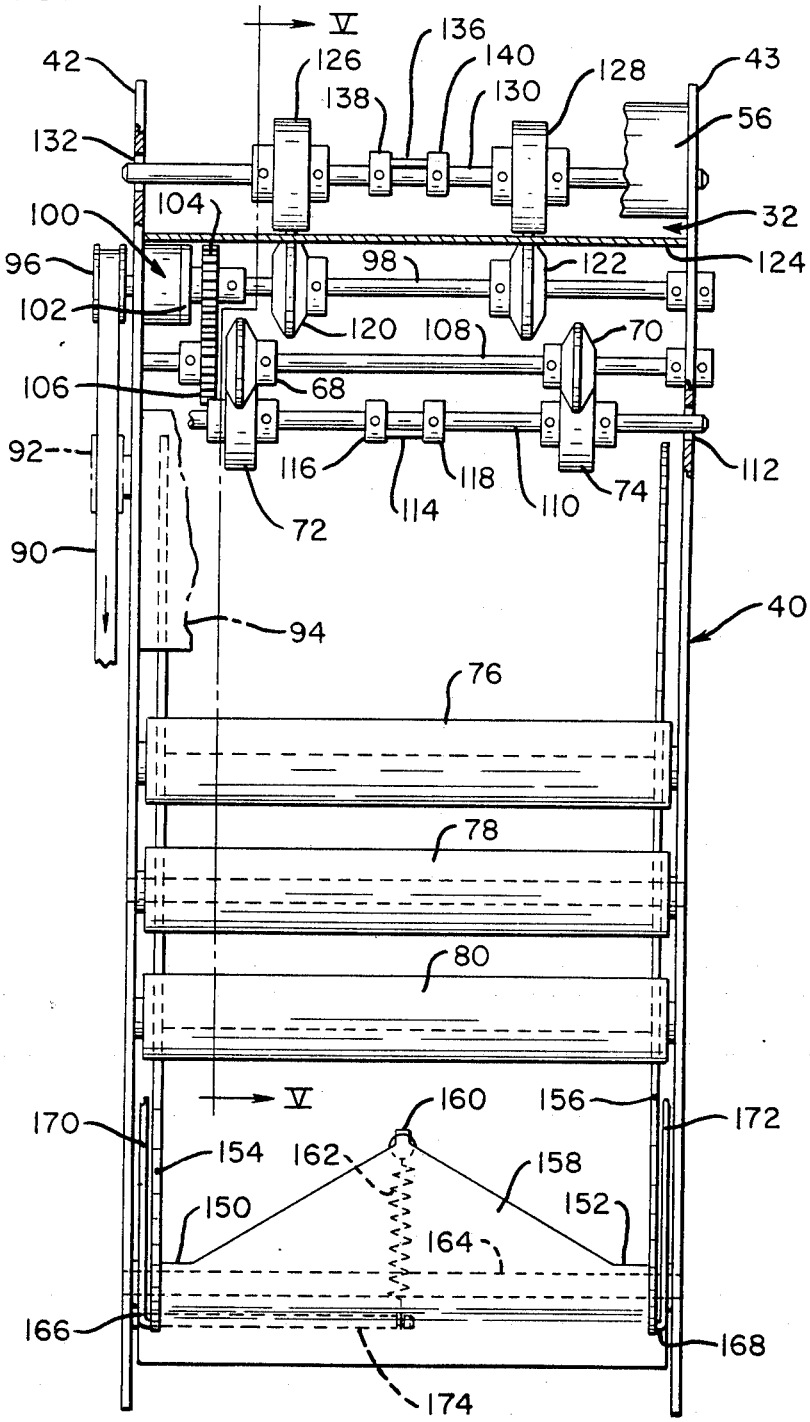
FIG. 4 is an end view looking from the direction A of FIG. 3 to show additional details of the currency dispenser shown in FIG. 3.

The motor 94 (FIGS. 3 and 4) is also used to drive the strip 58 on which the bills 30 are located. The drive belt 90 from the pulley 92 also is in driving engagement with a pulley 96 to rotate it in a clockwise direction as viewed in FIG. 3. The pulley 96 is fixed to shaft 98 to rotate it, and the shaft 98 passes through a conventional magnetic clutch 100 (FIG. 4) to provide the driving rotary motion thereto when the clutch is energized. The clutch 100 has a plate 102 associated therewith and the plate is coupled to a gear 104 which is rotatably mounted on the shaft 98 whch is continuously rotated whenever the motor 94 is energized. The clutch 100 is part of the carrier drive 48 and is operatively coupled to the control means 28 as shown in FIG. 1. Whenever the clutch 100 is energized by the control means 28, the plate 102 is rotated causing the gear 104 to be rotated therewith. Gear 104 is in driving engagement with a similar gear 106 which is fixed to the shaft 108 to rotate it whenever the clutch 100 is energized. The shafts 108 and 98 are rotatably supported in the side panels 42 and 43 as is best shown in FIG. 4. The drive pulleys 68 and 70 are fixed to shaft 108 to rotate therewith, and the back-up rollers 72 and 74 are rotatably supported on the rod 110. The ends of the rod 110 are supported in elongated slots 112 (as shown in FIG. 4) so as to enable the rollers 72 and 74 to be pushed away from the associated drive rollers 68 and 70 to facilitate the insertion of the strip 58 therebetween for the usual threading thereof. The rollers 72 and 74 are biased into engagement with the drive rollers 68 and 70 by a spring lever 114 (best seen in FIG. 3) whose end is maintained between the locators 116 and 118 to bias the rod 110 towards the shaft 108. Thus, whenever the clutch 100 is actuated, the currency carrier or strip 58 will be driven between the drive rollers 68 and 70 and their associated back-up rollers 72 and 74 at a velocity of, for example, $1\frac{2}{3}$ feet per second. This velocity of the strip 58 will produce an output of approximately 4 bills/second being discharged through the opening 32 in the housing 40. Increasing the speed of motor 94 will increase the discharge rate of bills 30 from the housing 40 and vice versa. It should be noted that the drive rollers 120 and 122 continuously rotate as long as the motor 94 is energized. The peripheries of the drive rollers 120 and 122 pass through aligned slots in a pick off member 124 and engage the back-up rollers 126 and 128, respectively, which are rotatably mounted on a rod 130. The ends of the rod 130 are mounted in elongated slots like slot 132 in FIG. 4 to enable the rollers 126 and 128 to be resiliently biased into engagement with the drive rollers 120 and 122, respectively. The rod 130 is restrained from axial movement within the housing 40 and is also biased towards the shaft 98 by a cantilever-type spring 134 whose free end 136 (FIG. 4) fits between the locators 138 and 140 which are fixed to the rod 130. The springs 134 and 114 are anchored to cross bars 142 and 144, respectively, (FIG. 3) which bars are secured between the side panels 42 and 43.

The pick-off member 124 (FIG. 3) lies in an imaginary plane which is parallel to and slightly below the plane of the strip 58 (as viewed in FIG. 3) prior to sliding over the element 66. The bill 30-1 in FIG. 3 is shown in the process of being picked off or separated from the currency carrier or strip 58. When discharging a bill 30 from the dispenser 22-1, the clutch 100 (FIG. 4) is energized long enough by the control means 28 (FIG. 1) to enable the leading edge of the bill 30-1 (FIG. 3) to be caught between the drive rollers 120 and 122 and their associated back-up rollers 126 and 128 to thereby be discharged out of the discharge opening 32 of the housing 40.

The currency counter 52, shown only diagrammatically in FIG. 1, includes a source of light such as a light emitting diode (LED) 146 and a complementary light responsive member 148 which are shown on opposed sides of the strip 58 in FIG. 3. The member 148 is operatively coupled to the control means 28 (FIG. 1) to indicate a count of the bills 30 being discharged whenever the light from the LED 146 to the light responsive member 148 is interrupted by a bill 30 passing therebetween. Because the strip 58 is made of a clear or transparent plastic material, an accurate count of the bills 30 interrupting the light path between the LED 146 and the member 148 is readily obtained.

The dispenser 22-1 also includes the brake mechanism 64 which is shown mainly in FIGS. 3 and 4. The basic function of the brake mechanism 64 is to keep the supply reel 60 from rotating when the strip 58 is stopped from being moved after a desired number of bills 30 is discharged from the housing 40.

The brake mechanism 64 is shown in the "on" position in FIG. 3 in which the supply reel 60 is prevented from being rotated by the shoes 150 and 152 of the mechanism 64 engaging the spaced flanges 154 and 156, respectively, of the reel 60 as is best shown in FIG. 4. The shoes 150 and 152 are extensions of a generally, triangularly-shaped plate 158 having an apex 160 to which one end of a tension spring 162 is secured so as to bias or urge the brake mechanism 64 to rotate about the rod 164 in a counterclockwise direction as viewed in FIG. 3. The plate 158 has extensions 166 and 168 from which the arms 170 and 172, respectively, extend as shown in FIG. 3. The arms 170 and 172 support the arcuately-shaped surface 62 over which the strip 58 slides or passes. The remaining end of spring 162 is secured to the free end of a cantilever-type rod 174 whose remaining end is secured to the side panel 42 as is best seen in FIG. 4.

Whenever the clutch 100 is operatively acutated, the strip 58 is moved to the right over the element 66 (as viewed in FIG. 3) causing the brake mechanism 64 to be rotated in a clockwise direction (from the position shown in FIG. 3), resulting in the brake shoes 150 and 152 being moved away from the associated flanges 154 and 156; this permits the strip 58 with the bills 30 thereon to be unwound from the supply reel 60. As bills 30 are discharged from the dispenser 22-1, the supply reel 60 rotates in a clockwise direction (as viewed in FIG. 3) and when the clutch 100 is deactuated to stop the dispensing of bills 30, there will be some rotational inertia left in the reel 60 which causes some slack to occur in the strip 58 between the reel 60 and the element 66. When this slack occurs in the strip 58, the spring 162 will urge the brake mechanism 64 in a counterclockwise direction (to the position shown in FIG. 3) causing the brake shoes 150 and 152 to engage the associated flanges 154 and 156 of the supply reel 60 to stop its rotation.

Figure 5:
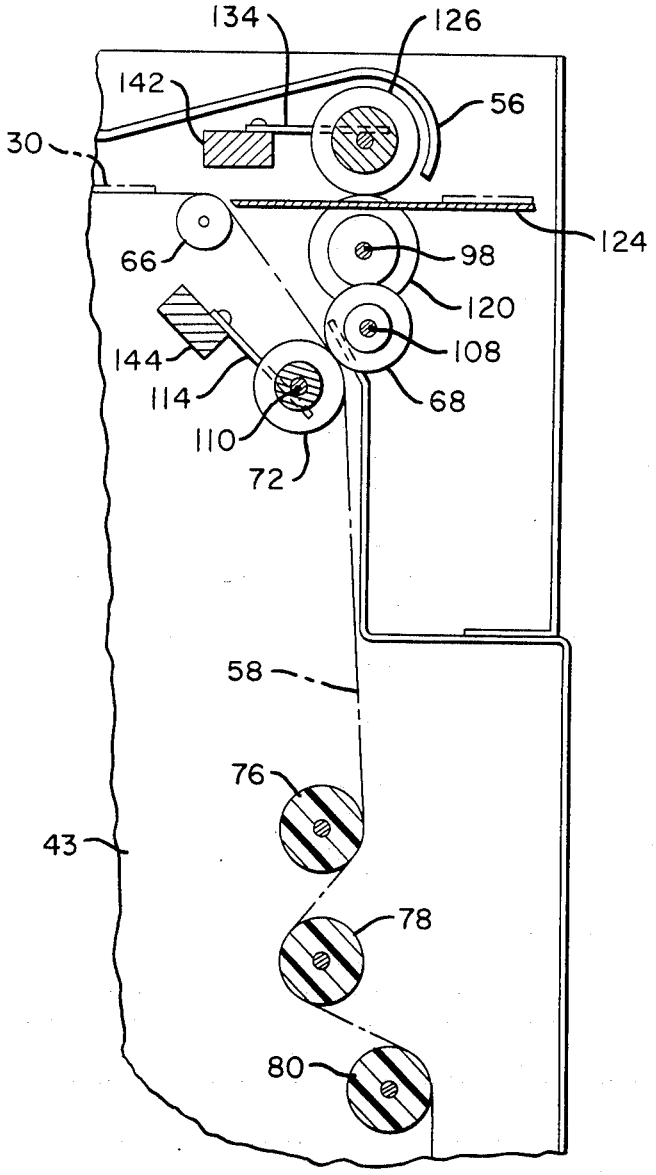
FIG. 5 is a cross-sectional view taken along the line 5—5 of FIG. 4 to show additional details of the currency carrier, carrier drive, and discharge means shown only in block form in FIG. 1.

In the dispenser 22-1 described in FIGS. 3, 4, and 5, the supply reel 60 has a diameter of approximately ten inches when storing about 3,000 bills of U.S.A. currency on the strip 58 which has a length of approximately 1,250 feet to accommodate storing 3,000 bills like 30 thereon. Under these circumstances, the take-up reel 82 has a diameter of about 4.5 inches for receiving a length of approximately 1,250 feet of strip 58 with no bills 30 thereon. For the embodiment of the dispenser 22-1 shown in FIGS. 3–5, the strip 58 is made of a clear flexible plastic material such as Mylar (which is manufactured by DuPont) and which strip 58 has a thickness of approximately 0.00092 inch and has a width of approximately 7.4 inches to accommodate the length of U.S.A. currency and a large percentage of foreign currency, traveller's checks, notes, and the like. A feature of this invention is that different sizes of currency (within limits) can be accommodated on the strip 58 without having to change its basic dimensions. The element 66 (FIG. 3) has a diameter of approximately 0.5 inch so as to provide an abrupt change of direction for the strip 58 as it slides over the element 66 on its way to the drive rollers 68 and 70 while the leading edge of a bill like 30-1 in FIG. 3 continues in a direction parallel to pick-off member 124. In the embodiment describe, the edge of the member 124 which is closest to the element 66 is spaced therefrom approximately 1/32 of an inch to effect the picking off of a bill like 30-1 from the strip 58.

Figure 6:
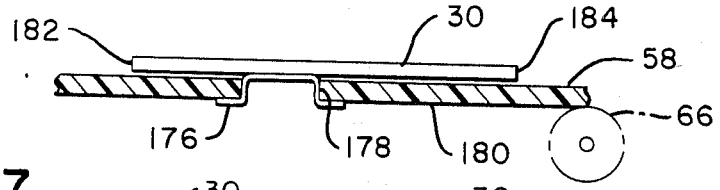
FIG. 6 is an enlarged cross-sectional view of a portion of the currency carrier shown in FIG. 3.

In the dispenser 22-1 shown in FIGS. 3–5, the bills 50 are detachably secured to the carrier or strip 58 by the adhesive members 176 (FIG. 3) which are shown enlarged in FIG. 6. The bills 30 are positioned on the strip 58 so that the length of each bill 30 is perpendicular to the length of the strip 58. For a wide range of sizes of currency, the adhesive members 176 are spaced apart on five inch centers as measured along the length of the strip 58 and are also placed on three and one-half inch centers across the width of the strip 58. The strip 58 has holes 178 punched therein to receive the adhesive members 176 as shown in FIG. 6. While the strip 58 is greatly exaggerated in thickness in FIG. 6, each adhesive member 176 is larger in area than the associated opening 178 (so as to adhere to the underside 180 of the strip 58) and during the loading of bills 30 on the strip 58, the adhesive member 176 is forced through the opening 178 gainst the associated bill 30 to detachably secure the bills 30 thereto. As an illustration, the adhesive members may be made of a silicon adhesive tape such as tape 3M 8402 which is manufactured by the 3M Company. In forcing the adhesive member 176 against the bill 30, a force of approximately 15 pounds on a ½ inch diameter plunger (not shown) was adequate to force each adhesive member 176 into the configuration shown in FIG. 6 so as to detachably secure the bills to the strip 58. The element 66 is shown in phantom outline in FIG. 6 just to assist the reader in orienting the strip 58 and bill 30 thereon. Each bill 30 is positioned preferably on the strip 58 (FIG. 6) so that its point of attachment thereto is effected closer to the trailing edge 182 of the bill 30 than to its leading edge 184; this facilitates the separation of each bill 30 from the strip 58 as the strip slides over the element 66 and the bill 30 slides over the pick-off member 124 (FIG. 3).

Different embodiments of the currency carrier 44, shown diagrammatically in FIG. 1, may be used with the currency dispenser 22-1 shown in FIGS. 3–5 and in place of the particular carrier described in relation to strip 58 shown in FIGS. 3–6. Certain portions of the currency dispenser 22-1 are shown only diagrammatically in FIG. 7 so as to orient the reader; like numerals are used in FIG. 7 for their identical counterparts shown in FIGS. 3–5.

Figure 7:
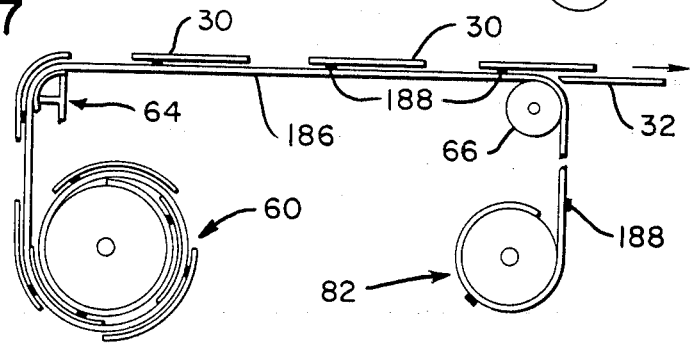
FIG. 7 is a view of another embodiment of the currency carrier shown only in block form in FIG. 1.
Figure 8:
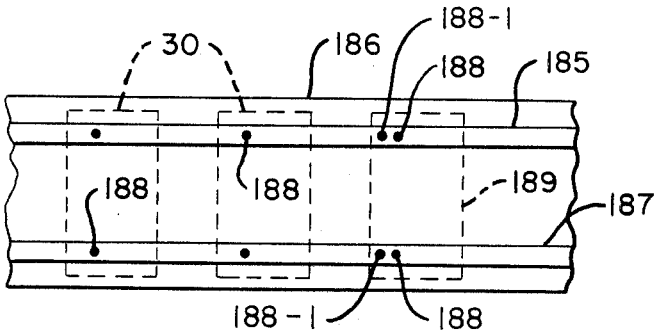
FIG. 8 is a plan view of a currency carrier which utilizes an adhesive for detachably securing the bills of currency thereto.

The currency carrier in FIG. 7 is comprised of a carrier strip 186 having the bills 30 detachably secured thereto by adhesive areas 188. The strip 186 has the same overall dimensions as does the strip 58 already described, and it is also made of the same material as strip 58. The adhesive areas 188 result from heating a thermally sensitive adhesive such as JET MELT adhesive which is manufactured by the 3M Company. The adhesive is applied to the carrier or strip 186 in the form of narrow strips 185 and 187 which are located in spaced parallel relationship along the length of the strip 186 as shown in FIG. 8. The bills 30 are positioned on the strip 186 as shown in dashed outline in FIG. 8 and heat is applied (via heated rods of approximately 0.040 inch diameter) to small areas 188 to detachably secure the bills 30 to the strip 186. As shown in FIG. 8, each bill 30 is secured to the strip 186 by applying heat to at least two spots to thermally-activate the adhesive and detachably secure the bill to the strip 186 at areas 188 which are closer to the trailing edge of the bill 30 than to the leading edge thereof which is numbered as 189 in FIG. 8. If found necessary or desirable, the strips 185 and 187, may be heated also at areas 188-1 (FIG. 8) to provide additional securement of the bills 30 to the carrier strip 186.

FIGS. 9, 10, and 11 show details of another embodiment of a currency carrier designated generally as 190. The carrier 190 may have the same overall length, width and thickness as do the strips 58 and 186 already described, and the carrier 190 may be included in the cash dispenser 22-1 (FIGS. 3–5). FIG. 11 shows how the carrier 190 coacts with certain elements of the dispenser 22-1, with similar reference numerals being used in FIG. 11 for identical elements shown in FIGS. 3–5.

The carrier 190 (FIG. 9) has a portion 192 removed therefrom to produce a tongue-like member 194 which has an upwardly bent portion 196 near its base and a downwardly-bent portion 198 at its free end so as to enable a bill 30 to be retained under the tongue-like member 194 as shown in FIGS. 9 and 10. The carrier 190 also has two "C"-shaped areas 200 removed therefrom to produce the spaced, short tabs 202. As is best seen in FIG. 9, after a bill 30 is placed on the carrier 190, the trailing edge of the bill 30 is placed under the two tabs 202 and the leading edge 204 of the bill is retained by the downwardly-bent portion 198 of the tongue-like member 194 to secure the bill 30 on the carrier 190. The spacing of the bills 30 on the carrier 190 is identical to that employed with the strips 58 and 186 when used in the dispenser 22-1; however, the spacing may be changed to suit particular applications. The forming of the upwardly-bent portion 196 and the downwardly-bent portion 198 may be effected conventionally by rotary dies during the same time that the notched out portions 192 and 200 are formed.

FIG. 11 is a schematic diagram showing how the bills 30 are separated from the carrier 190 near the discharge opening 32 of the currency dispenser 22-1. As the carrier 190 slides over the element 66, the tongue-like member 194 continues to travel in a direction which is parallel to and above the pick off member 124, and the bill 30 (not shown in FIG. 11) also continues to travel in this direction under the tongue-like member 194. Finally, the tongue-like member (shown as 194-1 in FIG. 11) is pushed backwardly with respect to the direction of the carrier prior to eventually being wound up on the take-up reel 82, and the separated bill 30 is fed out the discharge opening 32 as previously explained.

Figure 12:
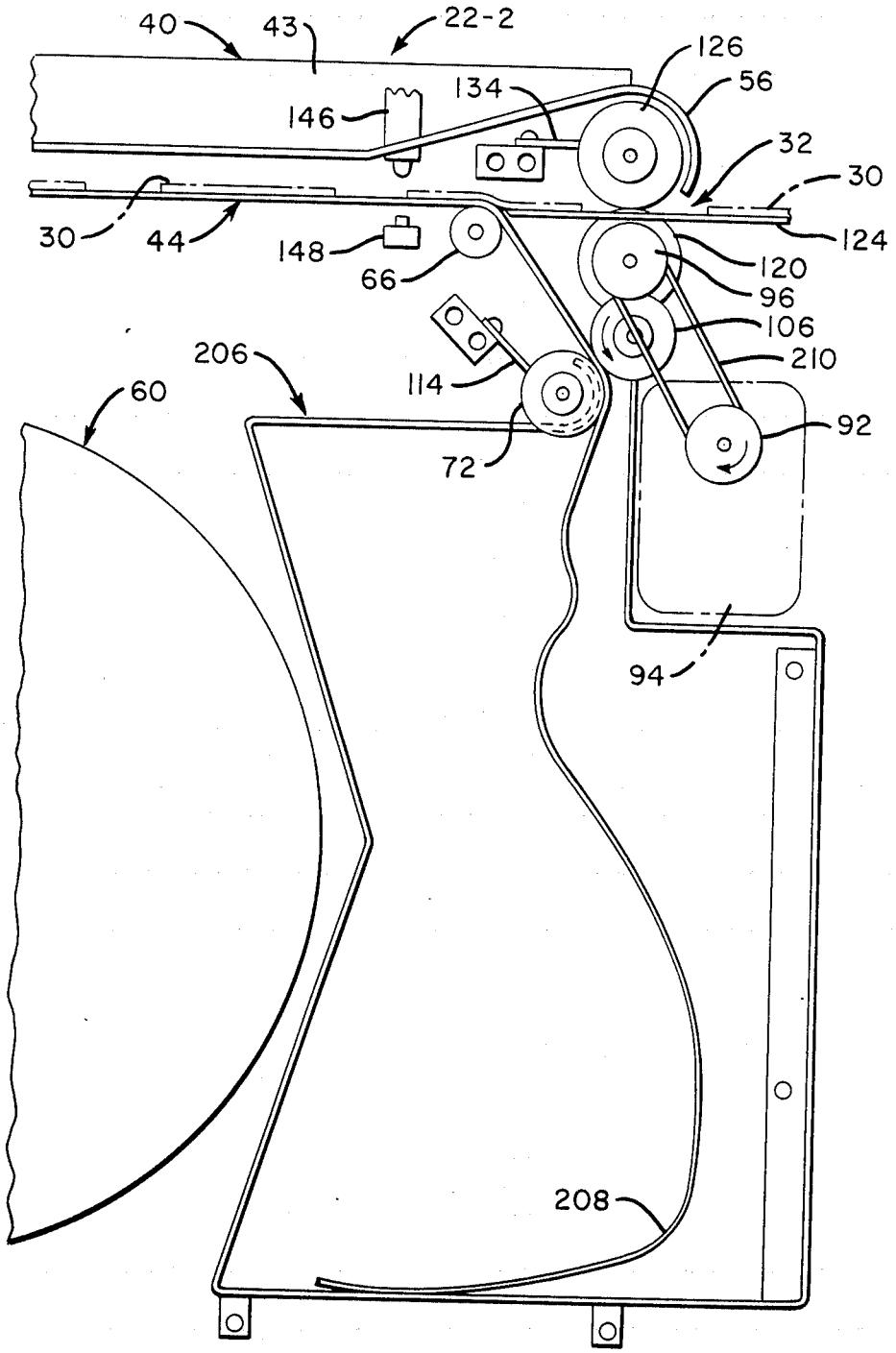
FIG. 12 is a view similar to FIG. 3 showing another embodiment of this invention in which the take-up reel shown in FIG. 3 is replaced by a stuffing box.

FIG. 12 shows another embodiment of this invention referred to as currency dispenser 22-2 which is generally similar to the dispenser 22-1 (shown in FIGS. 3–5) except as hereinafter indicated. Like numerals are used in FIG. 12 for identical elements shown in FIGS. 3–5. The dispenser 22-2 has a stuffing box 206 which replaces the take-up reel 82, bin 89, and rods 76, 78, and 80 best shown in FIG. 3. The currency carrier, which may be any of the types already described in detail such as strips 58 or 186, for example, is just designated as 44 in FIG. 12 and is driven into the stuffing box 206 by the drive rollers like 106 and the back up rollers like 72. After the bills 30 are removed from the carrier 44, the carrier 44 drops into the stuffing box 206 and forms convolutions or folds 208 therein. The currency dispenser 22-2 stores approximately 1,000 bills of the U.S.A. currency size on the supply reel 60 when the stuffing box 206 is used, as the stuffing box 206 is not as efficient as is the take-up reel 82 (FIG. 3) in storing the empty carrier 44. The output pulley 92 of motor 94 (FIG. 12) is operatively coupled to the pulley 96 of the magnetic clutch 100 (not shown in FIG. 12) by a shorter gear-type drive belt 210 than was used in FIG. 3.

Figure 13:
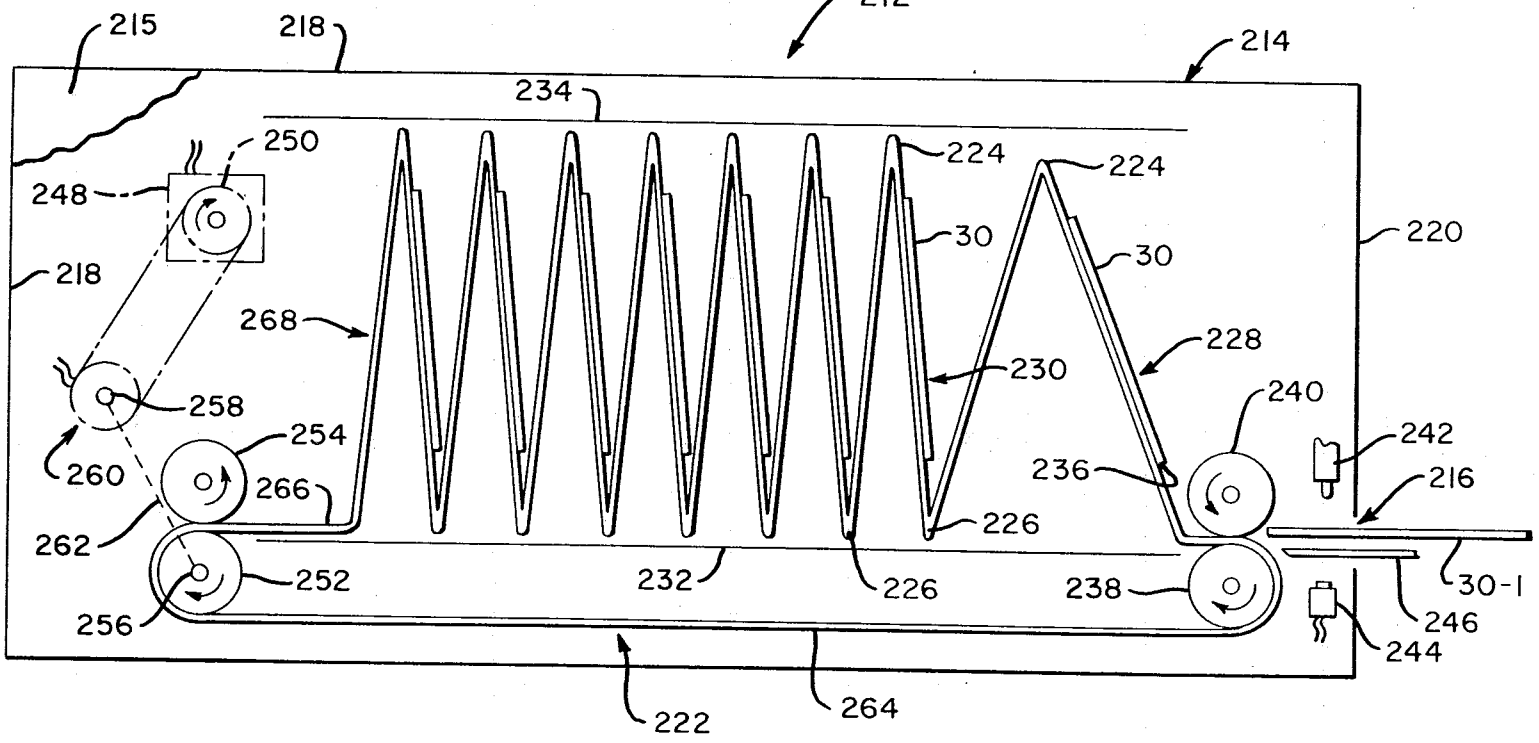
FIG. 13 is a diagrammatic view of another embodiment of this invention.

FIG. 13 is a diagrammatic side view of another embodiment of this invention which is designated generally as currency dispenser 212. The dispenser 212 includes a housing 214 having a discharge opening 216 therein through which the bills such as 30 are dispensed. The housing 214 has most of its side panel 215 removed to facilitate a showing of the interior of the housing 214. The housing 214 has conventional end panels such as 218 and 220 which can be conveniently opened to gain access to the interior of the housing 214 to enable it to be loaded with bills and conventionally closed and locked for transit to an individual ATT 20 (FIG. 1) as earlier explained herein.

The currency carrier for the currency dispenser 212 (FIG. 13) is comprised of an endless carrier 222 having a plurality of hinge portions such as 224 and 226 therein which may be formed by creasing the carrier 222 to form a plurality of fan folds like 228 and 230. A single bill 30 is placed in each of the folds like 230 as shown. There are guides 232 and 234 which are spaced apart in parallel relationship with each other and which are conventionally secured within the housing 214 to receive the fan folds like 228 and 230 of the carrier 222 therebetween as shown. When in the position shown in FIG. 13, the carrier 222 has a width which extends in a direction which is perpendicular to the plane of FIG. 13. The width of the bills 30 is seen in FIG. 13, and the lengths of these bills extend in the direction which is perpendicular to the plane of FIG. 13.

The leading edge 236 of the bill 30 (with regard to the discharge opening 216) is about to pass between the feed rolls 238 and 240, and thereafter pass out through the discharge opening 216 as shown by bill 30-1 shown in FIG. 13. The currency counter 50 (FIG. 1) is comprised of a source of light such as LED 242 and associated light responsive member 244 which is conventionally coupled to the control means 28 (FIG. 1) to give a count indication of the number of bills being dispensed. The dispenser 212 also includes a pick-off member 246 which performs the same function as does the pick-off member 124 already described in relation to FIG. 3. The pick-off member 246 may be made of clear or transparent plastic material, to permit the light from the LED 242 to pass therethrough when no bill 30 is present, or if the pick-off member 246 is made of an opaque material such as metal, it may have an aligned slot therein (not shown) to permit the light from LED 242 to pass therethrough to effect the counting of bills passing out of the dispenser 212.

The means for moving the carrier 222 within the housing 214 (FIG. 13) also includes the motor 248 having a driving pulley 250 extending therefrom, and it also includes the driving feed roll 252 and the back-up feed roll 254. The feed rolls 238, 240, 252 and 254 are cylindrical in shape and have resilient or rubber like surfaces to grip the carrier 222 therebetween. The roll 240 is resiliently biased into engagement with the roll 238, and similarly, the feed roll 254 is resiliently biased into engagement with the drive feed roll 252. The drive feed roll 252 has a driving shaft 256 which is rotated in a clockwise direction (as viewed in FIG. 13) by the output member 258 of a conventional magnetic rotary clutch 260 which is shown only diagrammatically in FIG. 13. The magnetic rotary clutch 260 is operatively coupled to the output pulley 250 of motor 248 which supplies the constant rotary motion to the clutch 260. Whenever clutch 260 is energized, the constant rotary motion supplied by motor 248 is supplied to the drive shaft 256 of drive roll 252 by a conventional coupling member shown only as dashed line 262 in FIG. 13.

When clutch 260 (FIG. 13) is energized by the control means 28 (FIG. 1), the drive roll 252 rotates. As drive roll 252 rotates, it causes the portion 264 of the carrier 222 between the feed roll 238 and drive feed roll 252 to move to the left as viewed in FIG. 13. This causes the leading edge 236 of bill 30 to move between the feed rolls 238 and 240 and out of the discharge opening 216 of the housing 214 as the carrier 222 moves around the feed roll 238. The pick-off member 246 facilitates the guiding of the bills such as 30-1 out of the discharge opening 216. After a portion of the carrier 222 passes around the drive feed roll 252, as for example portion 266 of carrier 222, it is pushed into the area 268 in the housing 214 in a general random manner so that it exerts a cumulative force on the remaining fan folds 228 and 230 between the planar guides 232 and 234 to move the fan folds like 230 to the right as viewed in FIG. 13.

The carrier 222 is made of clear plastic material as earlier explained herein and has a thickness of approximately 0.001 inch. While the dispenser 212 is shown in a preferred position for dispensing the bills 30 in a horizontal direction of the dispenser, the dispensing opening 216 of the dispenser 212 can be tilted upwardly at varying angles approaching 45 degrees from the position shown in FIGS. 13 and still work effectively. The use of any of the previously described means (such as those shown in FIGS. 6 and 8 for example) of attaching the bills 30 to the carrier will permit an angle of tilt greater than the 45 degrees mentioned for such applications of the dispenser 212 as dispensing bills 30 upwardly through a table top.

We claim:

1. A currency dispenser comprising:

a housing having a discharge opening therein;

a carrier means located within said housing for detachably retaining bills of currency in association therewith;

means for moving said carrier means within said housing so as to position successive ones of said bills adjacent to said discharge opening; and discharge means located near said discharge opening for removing successive ones of said bills from said carrier means and also for discharging successive ones of said bills through said discharge opening;

and means for sensing the number of said bills being discharged through said discharge opening;

said carrier means comprising spaced, opposed, first and second horizontally positioned guides to accommodate fan folds therebetween and also comprising a single flexible endless belt which has hinge portions at intervals to form said fan folds, said hinge portions being sufficiently spaced to enable successive ones of said bills to be accommodated between adjacent ones of said fan folds.

2. The currency dispenser as claimed in claim 1 in which said discharge means includes a first pair of feed rolls between which said belt and said bills pass to discharge said bills through said discharge opening; and said moving means includes a second pair of feed rolls between which said belt passes to thereafter accumulate between said first and second guides after said belt leaves said second pair of feed rolls.

3. The currency dispenser as claimed in claim 2 in which said first guide is positioned between said first and second pairs of feed rolls to lie in an imaginary plane which is parallel to a second imaginary plane including a first line of contact formed between said first pair of feed rolls and also including a second line of contact formed between said second pair of feed rolls, and in which said second guide is positioned parallel to said first guide and is located within said housing so that said second imaginary plane lies between said first and second guides.

4. A currency dispenser comprising:

a housing having a discharge opening therein;

a flexible carrier;

a plurality of bills of currency;

means for retaining said bills of currency on said carrier;

means for moving said carrier within said housing so as to position successive ones of said bills on said carrier adjacent to said discharge opening; and discharge means located near said discharge opening for removing successive ones of said bills from said carrier and also for discharging successive ones of said bills through said discharge opening;

said discharge means including a means for counting said bills as they are discharged through said discharge opening;

said moving means including an element positioned in said housing near said discharge opening to enable said carrier to change direction from a first direction to a second direction so as to facilitate the separation of said bills from said carrier;

said discharge means also including a pick-off member positioned along said first direction and also being aligned with regard to said discharge opening so as to enable a said bill to move along said first direction as said carrier is moved along said second direction to thereby separate a said bill from said carrier;

said retaining means comprising adhesive means for adhesively detachably securing said bills to said carrier in spaced relation thereon; and said carrier having first and second sides and also having a plurality of spaced openings along the length thereof, and said adhesive means including an area of adhesive being located on said first side of said carrier and also extending over an associated said opening so as to detachably secure a said bill which is located on said second side of said carrier.

5. The currency dispenser as claimed in claim 4 in which each of said bills has, with regard to its position on said carrier, a leading edge, a trailing edge and a midpoint therebetween, with each said bill being detachably adhesively secured to said carrier at a point between the midpoint and trailing edge of the associated said bill so as to facilitate the separation of said bill from said carrier.

6. The currency dispenser as claimed in claim 5 in which said carrier is transparent and has a length and a width, and each of said bills is oriented in spaced relationship on said carrier so that the length of a said bill is perpendicular to the length of said carrier when positioned thereon; and said counting means comprises a source of light positioned on said first side of said carrier near said discharge opening and a light responsive member positioned on said second side of said carrier so that the light from said source to said light responsive member is interrupted as a said bill passes therebetween.

7. The currency dispenser as claimed in claim 6 in which said moving means comprises:

a supply reel having said carrier and bills wound in a continuous spiral thereon;

a take-up reel for winding said carrier thereon after said bills are removed therefrom; and a drive means located between said element and said take-up reel for moving said carrier from said supply reel to and past said element along said second direction.

8. The currency dispenser as claimed in claim 7 in which said discharge means further comprises a second drive means located between said element and said discharge opening for moving said bills through said discharge opening.

9. A currency dispenser comprising:

a housing having a discharge opening therein;

a flexible carrier;

a plurality of bills of currency;

means for retaining said bills of currency on said carrier;

means for moving said carrier within said housing so as to position successive ones of said bills on said carrier adjacent to said discharge opening; and discharge means located near said discharge opening for removing successive ones of said bills from said carrier and also for discharging successive ones of said bills through said discharge opening;

said discharge means including a means for counting said bills as they are discharged through said discharge opening;

said moving means including an element positioned in said housing near said discharge opening to enable said carrier to change direction from a first direction to a second direction so as to facilitate the separation of said bills from said carrier;

said discharge means also including a pick-off member positioned along said first direction and also being aligned with regard to said discharge opening so as to enable a said bill to move along said first direction as said carrier is moved along said second direction to thereby separate a said bill from said carrier;

said retaining means comprising adhesive means for adhesively detachably securing said bills to said carrier in spaced relation thereon;

said carrier having first and second sides and also having a plurality of spaced openings along the length thereof, and said adhesive means including an area of adhesive being located on said first side of said carrier and also extending over an associated said opening so as to detachably secure a said bill which is located on said second side of said carrier;

each of said bills having, with regard to its position on said carrier, a leading edge, a trailing edge and a midpoint therebetween, with each said bill being detachably adhesively secured to said carrier at a point between the midpoint and trailing edge of the associated said bill so as to facilitate the separation of said bill from said carrier;

said carrier being transparent and having a length and a width, and each of said bills being oriented in spaced relationship on said carrier so that the length of a said bill is perpendicular to the length of said carrier when positioned thereon; and said counting means comprising a source of light positioned on said first side of said carrier near said discharge opening and a light responsive member positioned on said second side of said carrier so that the light from said source to said light responsive member is interrupted as a said bill passes therebetween;

said moving means comprising:

a supply reel having said carrier and bills wound in a continuous spiral thereon;

a take-up reel for winding said carrier thereon after said bills are removed therefrom; and a drive means located between said element and said take-up reel for moving said carrier from said supply reel to and past said element along said second direction;

said discharge means further comprising a second drive means located between said element and said discharge opening for moving said bills through said discharge opening;

said currency dispenser further including a control unit; and said first named drive means comprising:

a rotary clutch having an input member which is rotatably mounted on said housing and operatively coupled to said second drive means for moving said bills through said discharge opening;

said rotary clutch also having an output member which rotates whenever said rotary clutch is energized; and opposed drive rollers for moving said carrier from said supply reel to and past said element along said second direction whenever said opposed drive rollers are rotated; and means connecting said output member with said opposed drive rollers to rotate them whenever said rotary clutch is energized by said control unit.

10. The currency dispenser as claimed in claim 9 further comprising:

a slip clutch operatively connected to said take-up reel to maintain a predetermined amount of tension on said carrier as it is wound on said take-up reel;

means for providing a predetermined amount of drag on said carrier before it enters said take-up reel;

a motor located within said housing for rotating said input member of said rotary clutch and said slip clutch; and means for braking said supply reel whenever a predetermined amount of slack occurs in said carrier between said supply reel and said element.

11. The currency dispenser as claimed in claim 10 in which said carrier is made of a plastic having a thickness of approximately one thousandth of an inch; and said element has a cylindrical surface which facilitates the separation of said bills from said carrier.

12. A currency dispenser comprising:

a housing having a discharge opening therein;

a flexible carrier;

a plurality of bills of currency;

means for retaining said bills of currency on said carrier;

means for moving said carrier within said housing so as to position successive ones of said bills on said carrier adjacent to said discharge opening; and discharge means located near said discharge opening for removing successive ones of said bills from said carrier and also for discharging successive ones of said bills through said discharge opening;

said discharge means including a means for counting said bills as they are discharged through said discharge opening;

said moving means including an element positioned in said housing near said discharge opening to enable said carrier to change direction from a first direction to a second direction so as to facilitate the separation of said bills from said carrier;

said discharge means also including a pick-off member positioned along said first direction and also being aligned with regard to said discharge opening so as to enable a said bill to move along said first direction as said carrier is moved along said second direction to thereby separate a said bill from said carrier;

said retaining means including a plurality of spaced fingers which are formed in said carrier along the length thereof to detachable retain said bills thereon;

each of said fingers having a free end and each said bill having a leading edge and a trailing edge with regard to its position on said carrier; and said free end of said finger engaging a leading edge of an associated said bill to detachably retain said bill on said carrier.

13. The currency dispenser as claimed in claim 12 in which said carrier has first and second opposed sides, with said bills and said fingers being positioned on said first side and with said second side of said carrier being in sliding engagement with an arcuately shaped surface of said element.

14. The currency dispenser as claimed in claim 13 in which said carrier has notched-out areas removed therefrom forming left and right fingers which are positioned on opposite sides of an associated said finger to assist in detachably retaining a bill to said carrier.

* * * * *